US006589653B2

(12) United States Patent
Lin

(10) Patent No.: US 6,589,653 B2
(45) Date of Patent: Jul. 8, 2003

(54) FILAMENT HAVING A QUADRILOBATE EXTERIOR CROSS-SECTION AND A FOUR-SIDED VOID

(75) Inventor: Perry Han-Cheng Lin, Canton, GA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/924,193

(22) Filed: Aug. 8, 2001

(65) Prior Publication Data

US 2003/0039827 A1 Feb. 27, 2003

(51) Int. Cl.[7] ..... D01F 6/00

(52) U.S. Cl. ..... 428/398; 428/397; 428/376; 428/92

(58) Field of Search ..... 428/398, 397, 428/376, 92

(56) References Cited

U.S. PATENT DOCUMENTS

| | | | |
|---|---|---|---|
| 2,939,201 | A | 6/1960 | Holland |
| 2,939,202 | A | 6/1960 | Holland |
| 3,109,220 | A | 11/1963 | McKinney et al. |
| 3,210,438 | A | 10/1965 | Chapman |
| 3,225,114 | A | 12/1965 | Chapman |
| 3,323,168 | A | 6/1967 | Vandrunen et al. |
| 3,329,553 | A | 7/1967 | Sims et al. |
| 3,493,459 | A | 2/1970 | McIntosh et al. |
| 3,528,128 | A | 9/1970 | Murakami et al. |
| 3,555,600 | A | 1/1971 | Moore |
| 3,558,420 | A | 1/1971 | Opfell |
| 3,600,491 | A | 8/1971 | Shimoda et al. |
| 3,745,061 | A | 7/1973 | Champaneria et al. |
| 3,810,876 | A | 5/1974 | Cowell et al. |
| 4,020,229 | A | 4/1977 | Cox, Jr. |
| 4,279,053 | A | 7/1981 | Payne et al. |
| 4,492,731 | A | 1/1985 | Bankar et al. |
| 4,639,397 | A | 1/1987 | Sato et al. |
| 4,648,830 | A | 3/1987 | Peterson et al. |
| 4,770,938 | A | 9/1988 | Peterson et al. |
| 4,836,763 | A | 6/1989 | Broaddus |
| 4,850,847 | A | 7/1989 | Samuelson |
| 4,861,661 | A | 8/1989 | Samuelson |
| 4,956,237 | A | 9/1990 | Samuelson |
| 5,082,723 | A | 1/1992 | Gross et al. |
| 5,108,684 | A | 4/1992 | Anton et al. |
| 5,125,818 | A | 6/1992 | Yeh |
| 5,168,143 | A | 12/1992 | Kobsa et al. |
| 5,190,821 | A | 3/1993 | Goodall et al. |
| 5,208,107 | A | 5/1993 | Yeh et al. |
| 5,230,957 | A | 7/1993 | Lin |
| 5,259,753 | A | 11/1993 | Kobsa |
| 5,279,897 | A | 1/1994 | Goodall et al. |
| 5,322,736 | A | 6/1994 | Boyle et al. |

(List continued on next page.)

FOREIGN PATENT DOCUMENTS

| | | |
|---|---|---|
| DE | 30 11 118 | 10/1981 |
| DE | 19622216 | 6/1996 |
| EP | 0 016 450 | 3/1980 |

(List continued on next page.)

*Primary Examiner*—N. Edwards

(57) ABSTRACT

A synthetic polymer filament is characterized by a four-sided void that extends centrally and axially through the filament. Each apex of the void extends toward the approximate midpoint of one side of the exterior configuration of the filament. The four-sided void has a modification ratio in the range from about 1.2 to about 2.0 and occupies from about five percent 5% to about thirty percent 30% of the cross sectional area of the filament.

A spinneret plate for producing the thermoplastic synthetic polymer filament has a cluster of four orifices centered about a central point. Each orifice includes a generally isosceles triangle-shaped major portion from which extends a pair of legs, each leg of one orifice being spaced from the leg of an adjacent orifice to define a gap therebetween.

1 Claim, 3 Drawing Sheets

U.S. PATENT DOCUMENTS

| | | | |
|---|---|---|---|
| 5,362,563 | A | 11/1994 | Lin |
| 5,370,935 | A | 12/1994 | Agarwal et al. |
| 5,380,592 | A | 1/1995 | Tung |
| 5,498,386 | A | 3/1996 | Lin et al. |
| 5,523,155 | A | 6/1996 | Lin et al. |
| 5,686,121 | A | 11/1997 | Samuelson |
| 6,048,615 | A | 4/2000 | Lin |

FOREIGN PATENT DOCUMENTS

| | | |
|---|---|---|
| EP | 0 201 812 | 5/1986 |
| EP | 0373655 | 12/1989 |
| EP | 0 516 119 | 5/1992 |
| EP | 0595953 | 7/1992 |
| EP | 0736113 | 12/1994 |
| EP | 0824608 | 5/1996 |
| GB | 944744 | 5/1962 |
| JP | 60-007045 | 7/1978 |
| JP | 54015023 | 2/1979 |
| JP | 55142710 | 4/1979 |
| JP | 55158380 | 12/1980 |
| JP | 57-49657 | 10/1982 |
| JP | 61089314 | 10/1984 |
| JP | 60-231818 | 11/1985 |
| JP | 61-083307 | 4/1986 |
| JP | 63175109 | 1/1987 |
| JP | 62-28203 | 6/1987 |
| JP | 04-272215 | 9/1992 |
| JP | 62-206008 | 11/1993 |
| JP | 7238419 | 9/1995 |
| JP | 09217225 | 2/1996 |
| WO | 92/08828 | 5/1992 |
| WO | 93/02234 | 2/1993 |
| WO | 94/13869 | 6/1994 |
| WO | 95/17539 | 6/1995 |
| WO | 99/39029 | 8/1999 |

FILAMENT HAVING A QUADRILOBATE EXTERIOR CROSS-SECTION AND A FOUR-SIDED VOID

BACKGROUND OF THE INVENTION

1. Field of the Invention

The present invention relates to a generally four-sided filament having a central axial four-sided void useful as a carpet yarn able simultaneously to impart both good color strength and relatively high "glitter" to a carpet made therefrom, and, to a spinneret plate for producing the filament.

2. Description of the Prior Art

"Glitter", when describing a filament used to form a carpet yarn, is a characteristic of the luster of the yarn and refers to the shiny appearance of the yarn when light is reflected by the filaments. A yarn having high glitter is also synonymously described in the art as having a "metallic" luster or a high degree of "sparkle".

Carpet yarns having levels of glitter higher than those used in the past have become fashionable. U.S. Pat. No. 6,048,615 (Lin, RD-7395) assigned to the assignee of the present invention, discloses a trilobial filament formed from a thermoplastic synthetic polymer material, which exhibits high glitter, excellent durability, and good soiling resistance.

It is also desirable in some instances that the carpet yarn imparts good color strength in addition to imparting a high glitter. Color strength is a measure of the depth of color richness of a carpet.

In view of the foregoing, it is believed advantageous to provide a yarn useful as a carpet yarn that exhibits a relatively high glitter, yet at the same time has a good color strength.

SUMMARY OF THE INVENTION

In one aspect the present invention is directed to a thermoplastic synthetic polymer filament which, due to its combination of good color strength and high glitter, is believed to be especially useful as carpet yarn. The filament of the present invention has a four-sided exterior configuration with an exterior modification ratio in the range from about 1.15 to about 2.0. The filament has a four-sided void extending centrally and axially therethrough. Each apex of the four-sided void extends toward the approximate midpoint of one respective side of the exterior configuration of the filament. The four-sided void has a modification ratio in the range from about 1.2 to about 2.0 and occupies from about five percent (5%) to about thirty percent (30%) of the cross sectional area of the filament.

In another aspect the present invention is directed to a spinneret plate for producing the thermoplastic synthetic polymer filament as above described. The spinneret plate has a cluster of four orifices centered about a central point. Each orifice includes a generally isosceles-triangle-shaped major portion from which extends a pair of legs, each leg of one orifice being spaced from the leg of an adjacent orifice to define a gap therebetween.

BRIEF DESCRIPTION OF THE DRAWINGS

The invention will be more fully understood from the following detailed description, taken in connection with the accompanying drawings, which form a part of this application and in which.

DETAILED DESCRIPTION OF THE INVENTION

Figure 1:
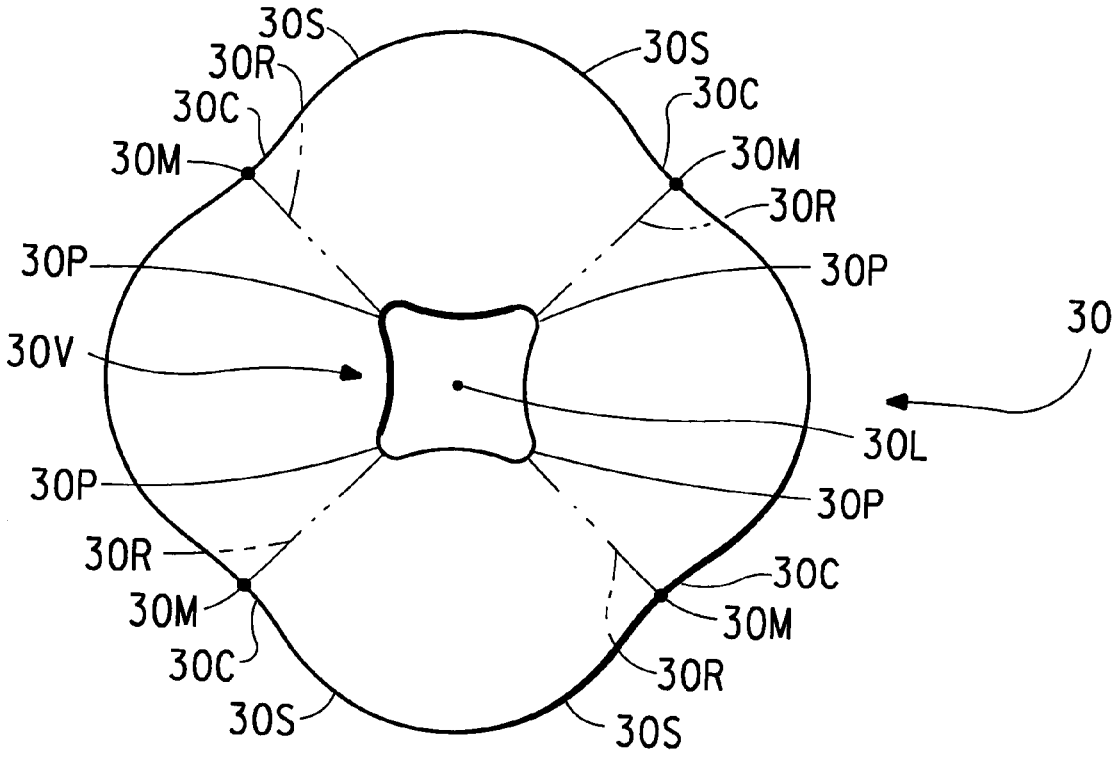
FIG. 1 is a cross sectional view of a filament in accordance with the present invention as prepared in Example 1 hereof.

Throughout the following detailed description similar reference numerals refer to similar elements in all Figures of the drawings.

FIG. 1 is a cross section view of a thermoplastic synthetic polymer filament generally indicated by the character 30 in accordance with the present invention. Generally speaking, a filament 30 in accordance with the present invention has a four-sided exterior configuration. More particularly, the filament 30 as illustrated in FIG. 1 may be characterized as having an exterior configuration that is substantially square in axial cross-section with each side 30S having a slight concavity 30C formed therein. Each concavity 30C lies approximately midway along a side 30S of the exterior configuration of the filament 30.

The filament 30 has an exterior modification ratio in the range from about 1.15 to about 2.0. An increased modification ratio of the exterior of the filament may result in increased soilability.

The filament 30 has a four-sided void 30V extending centrally and axially therethrough. The central void 30V is substantially square-shaped and has a modification ratio ranging from about 1.2 to about 2.0. The central void 30V may occupy between about five percent (5%) of the cross sectional area of the filament 30 to about thirty percent (30%) of the cross sectional area of the filament 30. In accordance with the present invention the central void 30V is positioned with respect to central axis 30L of the filament 30 such that each apex 30P of the void 30V extends toward the concavity 30C of the respective proximal side of the exterior configuration of the filament. As indicated in FIG. 1 each apex 30P of the void 30V is generally radially aligned along a reference line 30R with the midpoint 30M of each side of the exterior configuration of the filament 30.

A filament in accordance with the present invention may be prepared using a synthetic, linear, thermoplastic melt-spinnable polymers. Suitable polymers include polyamides, polyesters, and polyolefins. The polymer is first melted and then the polymer is extruded ("spun") through a spinneret plate 40 (to be described hereinafter) under conditions which vary depending upon the individual polymer and the particular filament geometry being spun thereby to produce a filament having a desired denier and a desired void percentage. Void percentage can be increased by more rapid quenching and increasing the melt viscosity of thermoplastic melt polymers, which can slow the flow allowing sturdy pronounced molding to occur.

Figures 2, 3:
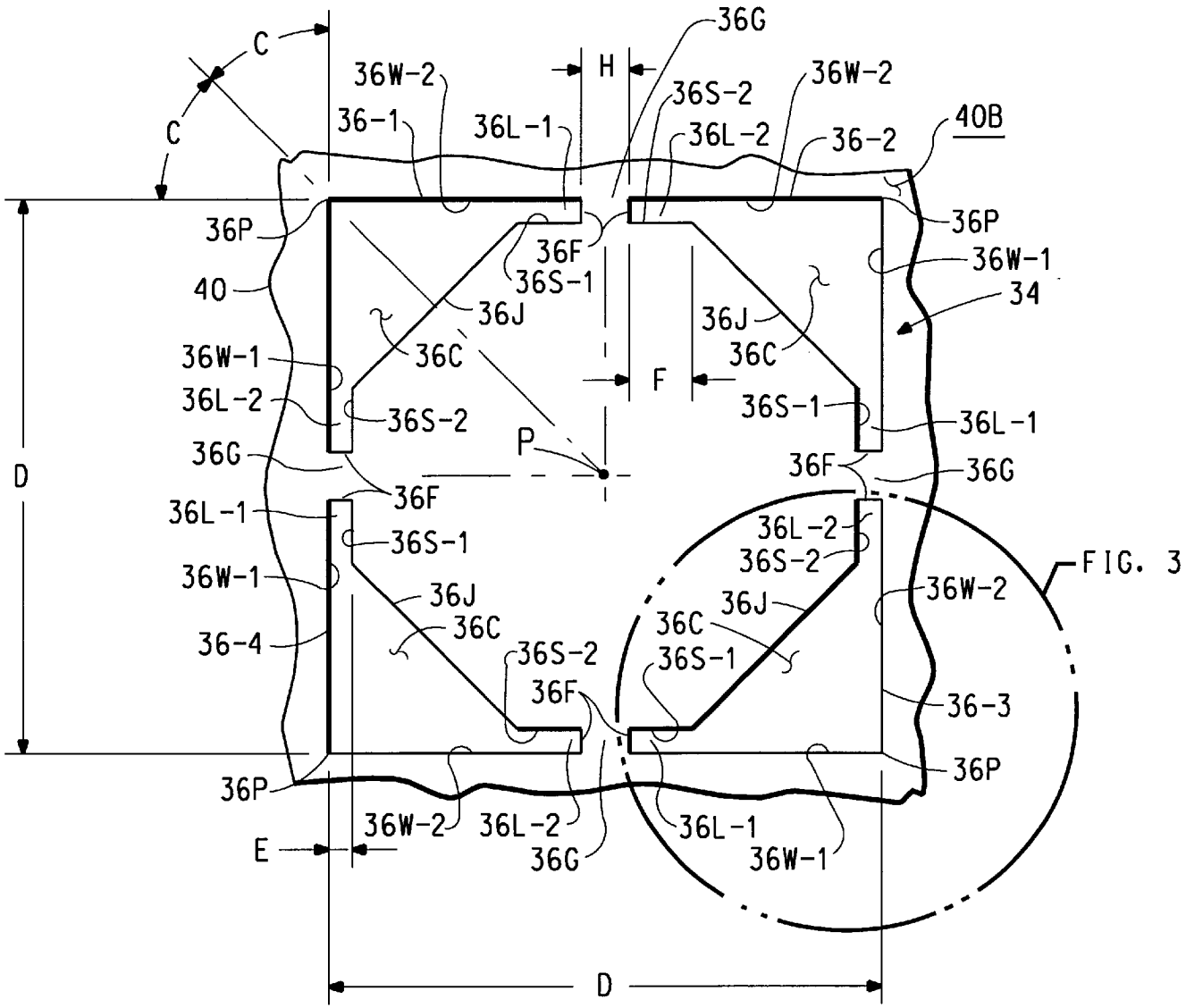
FIG. 2 is a view of the bottom surface of a spinneret plate having a cluster of orifices formed therein for producing the filament shown in FIG. 1.
FIG. 3 is enlarged view of the circled portion of FIG. 2.
Figure 3:
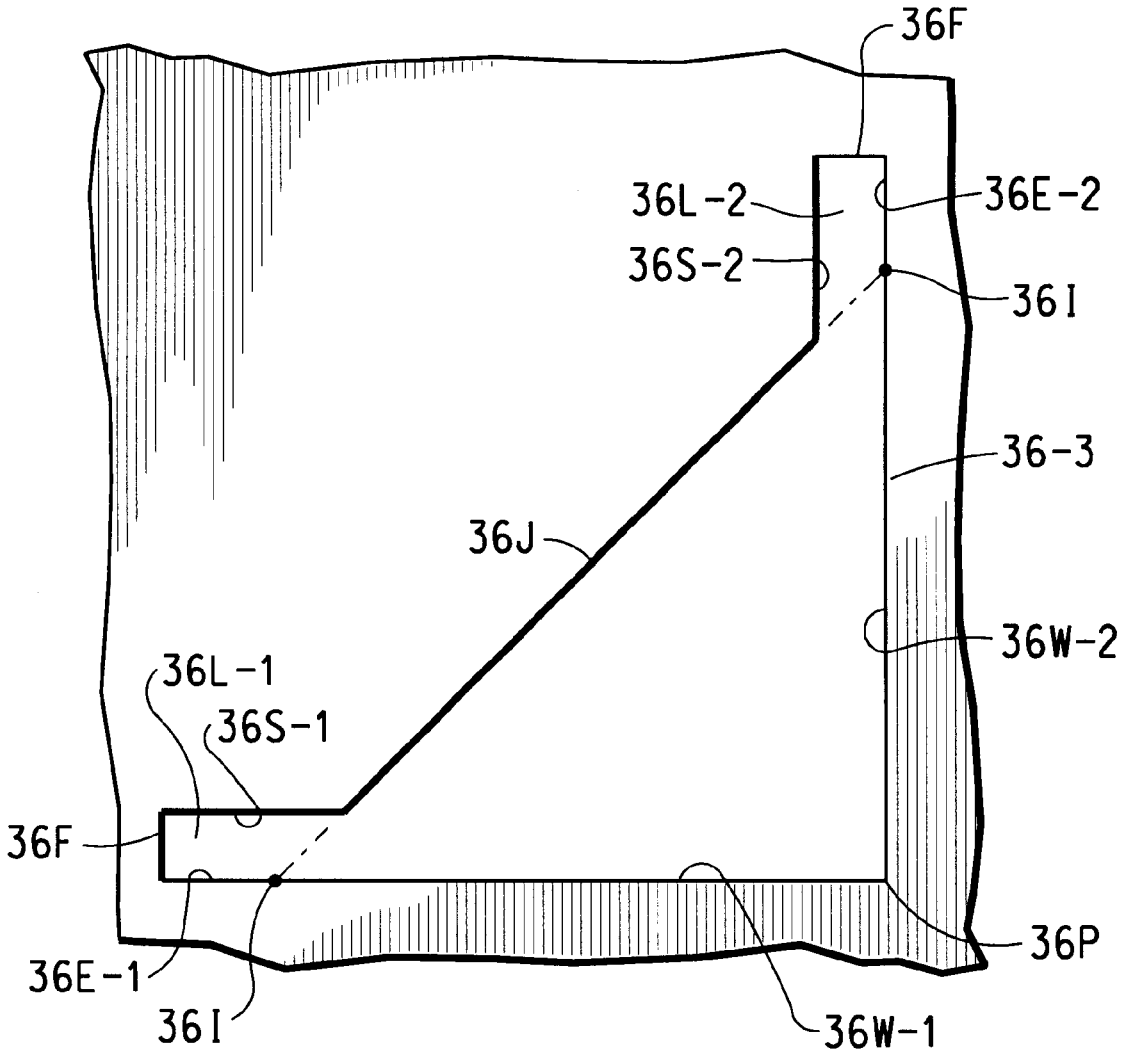

In another aspect the present invention is directed to a spinneret plate 40 for producing the filament depicted in FIG. 1. A view of the bottom surface 40B of the spinneret plate 40 is shown in FIG. 2 while an enlarged portion of the bottom surface 40B is illustrated in FIG. 3.

As is known in the art a spinneret plate 40 is a relatively massive member having an upper surface (not shown) and a bottom surface 40B. A portion of the upper surface of the spinneret plate is provided with a bore recess (not shown)

whereby connection of the plate 40 to a source of polymer may be effected. Depending upon the rheology of the polymer being used the lower margins of the bore recess may be inclined to facilitate flow of polymer from the supply to the spinneret plate. If provided, a typical angle of inclination is on the order of one hundred fifty degrees (150°).

A capillary generally indicated by the reference character 34 extends through the plate 40 from the recessed upper surface to the bottom surface 40B. As shown in FIG. 2 the capillary 34 is defined by a cluster of four orifices 36-1, 36-2, 36-3 and 36-4. The orifices 36-1, 36-2, 36-3 and 36-4 are centered about a central point P. Each orifice includes a generally isosceles-triangle-shaped central region 36C. A pair of legs 36L-1, 36L-2 project from each central region 36C.

The central region 36C of each triangle-shaped orifice is defined by a first outer wall 36W-1, a second outer wall 36W-2, and an inner joining wall 36J. The outer walls 36W-1 and 36W-2 on each triangle-shaped orifice intersect at a right angle to form a pointed end 36P. Each pointed end 36P is directed away from the central point P of the cluster. A line extending from point P through the pointed end 36P of a triangle-shaped orifice bisects the right angle formed by the intersection of the outer walls 36W-1 and 36W-2 of that orifice. Each angle C as indicated in FIG. 2 is thus a forty-five degree angle. The outer walls 36W-1, 36W-2 of the four triangle-shaped orifices 36-1, 36-2, 36-3 and 36-4 cooperate to form collectively the outline of a square on the bottom of the plate 40.

As may be observed from inspection of FIG. 3 each outer wall 36W-1, 36W-2, as the case may be, includes an extending wall segment 36E-1, 36E-2 that extends beyond the point 36I of intersection between the outer wall and the projection of the joining wall 36J. The projections of the joining wall 36J into the outer walls for the orifice 36-3 are indicated by the dashed lines in FIG. 3.

Stub wall segments 36S-1, 36S-2 extend from a respective end of the inner joining wall 36J. Each stub wall segment 36S-1, 36S-2 is in generally parallel relationship to the extending wall segment 36E-1, 36E-2 of the outer wall 36W-1, 36W-2 to which it is proximal.

The leg 36L-1 projecting from the central region of each orifice is defined by the extending wall segment 36E-1, the stub wall segment 36L-2 in parallel therewith, and a finishing wall segment 36F. The other projecting leg 36L-2 is similarly defined by the extending wall segment 36E-2, the stub wall segment 36L-2 in parallel therewith, and another finishing wall segment 36F. As seen in FIG. 2 confronting finishing wall segments 36F from adjacent triangle-shaped orifice are spaced from each other to define a gap 36G therebetween.

The spinneret plate may be fabricated using the laser technique disclosed in U.S. Pat. No. 5,168,143, (Kobsa et al., QP-4171-A), assigned to the assignee of the present invention.

EXAMPLES—COLOR STRENGTH COMPARISON

The following experiments were performed to measure the "Color Strength" of carpets made from filaments in accordance with the present invention. "Color Strength" is a measure of darkness and richness of color.

Filaments having a cross-section as shown in FIG. 1 and an exterior modification ratio of about 1.3 were produced using a spinneret plate having a capillary 34 as illustrated in FIGS. 2 and 3 with a bore recess diameter in the upper surface of 0.156 inches and a cap depth of 0.0180 inches. "Cap depth" is the distance between the lower surface 40B of the spinneret plate and the bottom of the bore recess, measured perpendicular to the lower surface 40B. It is the thickness of the material of the spinneret plate that actually forms the orifice.

The plate had the dimensions "D", "E", "F" and "H" (indicated by the corresponding reference characters on FIG. 2) as follows:

$D = 0.080$ inches $E = 0.004$ inches $F = 0.008$ inches $H = 0.006$ inches

In a screw melter nylon 6,6 polymer was melted and held at a temperature of two hundred eighty-six degrees Centigrade (286° C.) and was spun at a throughput of five hundred seventy-five grams per minute (575 g/min). One hundred twenty-eight (128) filaments were then drawn through a quenching chimney having a quench airflow with air temperature at ten degrees Centigrade (10° C.) and an airflow rate of three hundred forty cubic feet per minute (340 cfm). The quenched filaments were drawn by a feed roll at a speed of nine hundred seventy-two yards per minute which, in turn, was drawn again by the draw rolls drawing at twenty-five hundred seventy-eight yards per minute (2578 ypm), a draw ratio of 2.65. The draw roll temperature was one hundred ninety-five degrees Centigrade (195° C.). Next, a bulking jet at two hundred forty degrees Centigrade (240° C.) and one hundred twenty pounds per square inch (120 psi) crimped the heated filaments before they moved onto a perforated surface of a bulking drum rotating at sixty-five revolutions per minute (65 rpm) inside a bulking chest. Finally, the filaments were taken by a pair of take-up rolls and wound onto winders rotating at twenty-one hundred ninety-five yards per minute (2195 ypm).

The central void (as illustrated at reference character 30V in Example 1) occupied about nine percent (9) of the cross sectional area of the filament 30. The filament had a void modification ratio of 1.4.

The filaments were tufted to form a loop pile carpet construction.

Invention Examples 1A and 1B

Carpet Example 1A ("Light Gray" in color) and Carpet Example 1B ("Spice" in color) were tufted from filaments in accordance with the present invention prepared as described. For the filaments of Example 1A pigment concentrates of Black 64, Red 66, and Blue 74 were added at the screw-melter to impart the "Light Gray" color to the filament. Pigment concentrates of Black 64, Red 63, and Yellow were added at the screw-melter to impart the "Spice" color for the filaments of Example 1B.

Examples 2 and 3

Two three-sided filaments having a single three-sided-void, both in accordance with U.S. Pat. No. 6,048,615 (Lin, RD-7395), were manufactured using the same process as used to prepare Examples 1A and 1B. One three-sided filament was light gray in color, while the other three-sided filament was spice in color. Carpet Example 2 was tufted from the three-sided light-gray filaments. Carpet Example 3 was tufted from the three-sided spice-colored filaments.

Examples 4 and 5

Two four-sided filaments each having four distinct voids, both in accordance with U.S. Pat. No. 5,190,821 (Goodall et al., RD-5865), were manufactured using the same process as used to prepare Examples 1A and 1B. Carpet Example 4 was tufted from a four-sided filament that was gray in color. Carpet Example 5 was tufted from a four-sided filament that was spice in color. Carpet Examples 4 and 5 served as color strength reference.

The "Color Strength" of Carpet Examples 1A and 1B, both made from the filaments in accordance with the present invention, was respectively compared to the "Color Strength" of Carpet Examples 2 and 3. In each of these comparisons the "Color Strength" of the appropriate Carpet Example 4 (i.e., "Light Gray") or Carpet Example 5 (i.e., or "Spice") was used as the color strength reference standard.

The method for performing the "Color Strength" comparisons was that described in ASTM D387-86.

The results of the "Color Strength" comparison are shown in Table 1.

TABLE 1

| Filament Characteristic | Color Strength |
|---|---|
| Example 1A- Invention<br>Light gray color<br>Four-sided, single void | 153.47 |
| Example 2- U.S. Pat. No. 6,048,615<br>Light gray color<br>Three-sided, single void | 109.32 |
| Example 4- U.S. Pat. No. 5,190,821<br>Light Gray Color Standard | 100.00 |
| Example 1B- Invention<br>Spice color<br>Four-sided, single void | 157.78 |
| Example 3- U.S. Pat. No. 6,048,615<br>Spice color<br>Three-sided, single void | 133.00 |
| Example 5- U.S. Pat. No. 5,190,821<br>Spice Color Standard | 100.00 |

Table 1 indicates that the "Color Strength" of both Carpet Examples 2 and 3 (109.32 and 133.00, respectively) was significantly better than the "Color Strength" of carpets made from the appropriate color strength reference standard. With respect to carpets made from filaments in accordance with the present invention, Table 1 clearly indicates that the "Color Strength" of Carpet Example 1A (153.47) was significantly better than the color strength of Carpet Example 2 (108.32), while the "Color Strength" of Carpet Example 1B (157.78) was also significantly better than the "Color Strength" of Carpet Example 3. Table 1 indicates that carpets made from filaments in accordance with the present invention had a darker, richer color than carpets made from three-sided filaments having a single three-sided-void (Examples 2 and 3).

EXAMPLES—GLITTER COMPARISON

A glitter comparison test was also conducted. Carpet Example 1C ("medium blue" in color) was tufted from filaments in accordance with the present invention prepared as described above. The carpet was dyed with blue dye (acid blue 25) to impart a "medium blue" color.

Comparative Samples A and B were, respectively, carpet samples formed from filaments having three and six voids, as described in U.S. Pat. No. 5,523,155 (Lin et al., RD-6965).

Comparative Sample C was a carpet formed from a square filament having four voids as described in U.S. Pat. No. 5,190,821 (Goodall et al., RD-5865).

The glitter value in Table 2 was measured by ten viewers evaluating glitter on a scale of "1" to "5", with "5" being the most glitter. The rating for each sample was averaged for the ten viewers to produce the value in Table 2.

The results are listed in Table 2 below.

TABLE 2

| Example 1C Invention | Comparative Sample A | Comparative Sample B | Comparative Sample C |
|---|---|---|---|
| 4.0 | 1.7 | 1.0 | 1.6 |

It is clear from Table 2 that the glitter of the carpet tufted from the filament of the present invention was far superior to the glitter values of the comparative samples.

A similar glitter comparison was reported in U.S. Pat. No. 6,048,615 (Lin, RD-7395), in which a carpet made from three-sided filaments having a single three-sided-void (reported in Table 3 as "Example 1") was compared to carpets similar to Comparative Samples A through C of Table 2. (Note that the filaments used in "Example 1" of Table 3 are the same filaments as used to produce Carpet Examples 2 and 3 of Table 1.)

The results of the glitter comparison from U.S. Pat. 6,048,615 are reproduced in Table 3.

TABLE 3*

| Example 1 of U.S. Pat. No. 6,048,615 | Comparative Sample A | Comparative Sample B | Comparative Sample C |
|---|---|---|---|
| 5.0 | 1.7 | 1.0 | 1.6 |

*Copied from U.S. Pat. No. 6,048,615

Tables 2 and 3 show that, when compared against the same comparative samples, the glitter value of Carpet Example 1C (tufted from filaments in accordance with the present invention) is close to but slightly less than the glitter value of a carpet tufted from a three-sided filament having a single three-sided-void.

Taken collectively the foregoing experiments demonstrate the filament of the present invention, when used as a carpet yarn, simultaneously imparts exceptional color strength and relatively high glitter to a carpet made therefrom.

Those skilled in the art, having the benefit of the teachings of the present invention as hereinabove set forth may effect modifications thereto. Such modifications are to be construed as lying within the scope of the present invention, as defined by the appended claims.

What is claimed is:

1. A thermoplastic synthetic polymer filament having an exterior configuration having four sides thereon and an exterior modification ratio in the range from about 1.15 to about 2.0.

the filament having a four-sided void extending centrally and axially therethrough, each apex of the void extending toward the approximate midpoint of one side of the exterior of the filament, the void having a modification ratio in the range from about 1.2 to about 2.0 the void occupying from about five percent (5%) to about thirty percent (30%) of the cross sectional area of the filament.

* * * * *